US012644169B2

(12) United States Patent
Asakawa et al.

(10) Patent No.: US 12,644,169 B2
(45) **Date of Patent: *Jun. 2, 2026**

(54) STEEL SHEET, MEMBER, AND METHODS FOR MANUFACTURING THE SAME

(71) Applicant: JFE Steel Corporation, Tokyo (JP)

(72) Inventors: Taiyo Asakawa, Tokyo (JP); Shimpei Yoshioka, Tokyo (JP); Shinjiro Kaneko, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 357 days.

This patent is subject to a terminal disclaimer.

(21) Appl. No.: 18/267,900

(22) PCT Filed: Dec. 24, 2021

(86) PCT No.: PCT/JP2021/048106
§ 371 (c)(1),
(2) Date: Jun. 16, 2023

(87) PCT Pub. No.: WO2022/138894
PCT Pub. Date: Jun. 30, 2022

(65) Prior Publication Data

US 2024/0052466 A1 Feb. 15, 2024

(30) Foreign Application Priority Data

Dec. 25, 2020 (JP) ..... 2020-216037

(51) Int. Cl.

| | |
|---|---|
| ***C22C 38/12*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.
CPC ..... *C22C 38/04* (2013.01); *C21D 8/02* (2013.01); *C21D 8/0226* (2013.01); *C21D 8/0236* (2013.01); *C21D 8/0273* (2013.01); *C22C 38/001* (2013.01); *C22C 38/02* (2013.01); *C22C 38/06* (2013.01); *C22C 38/12* (2013.01); *C22C 38/14* (2013.01); *C21D 2211/008* (2013.01)

(58) Field of Classification Search
CPC ..... C22C 38/12; C22C 38/14; C22C 38/26; C22C 38/28; C22C 38/48; C22C 38/50; C21D 2211/008
See application file for complete search history.

(56) References Cited

U.S. PATENT DOCUMENTS

| | | | | |
|---|---|---|---|---|
| 8,876,986 | B2 | 11/2014 | Hata et al. | |
| 2014/0090755 | A1* | 4/2014 | Ueda | C22C 38/28 148/330 |
| 2016/0053355 | A1* | 2/2016 | Takagi | C22C 38/26 148/333 |
| 2019/0203317 | A1 | 7/2019 | Yoshioka et al. | |
| 2020/0370140 | A1 | 11/2020 | Takashima et al. | |
| 2022/0186337 | A1 | 6/2022 | Sano et al. | |
| 2023/0069838 | A1 | 3/2023 | Yoshioka et al. | |

FOREIGN PATENT DOCUMENTS

| | | | |
|---|---|---|---|
| CN | 101316942 | A | 12/2008 |
| CN | 105829564 | A | 8/2016 |
| EP | 3 050 989 | A1 | 8/2016 |
| EP | 3276022 | A1 | 1/2018 |
| EP | 3828298 | A1 | 6/2021 |
| EP | 3875625 | A1 | 9/2021 |
| JP | 4427010 | B2 | 3/2010 |
| JP | 2010215958 | A | 9/2010 |
| JP | 4712882 | B2 | 6/2011 |
| JP | 2015-078392 | A | 4/2015 |
| WO | 2018062381 | A1 | 4/2018 |
| WO | 2018123356 | A1 | 7/2018 |
| WO | 2020079925 | A1 | 4/2020 |

(Continued)

OTHER PUBLICATIONS

Fukushima, "Recent Technological Progress in High Speed Continuous Annealing", Translations ISIJ, 1985, vol. 25, pp. 275-293.
Extended European Search Report for EP Application No. 21911031.9, dated Sep. 18, 2023, 9 pages.
International Search Report and Written Opinion for International Application No. PCT/JP2021/048106, dated Mar. 22, 2022, 6 pages.
Office Action (The First Office Action) issued Apr. 24, 2025, by the State Intellectual Property Office of People's Republic of China in corresponding Chinese Patent Application No. 202180086994.1 and an English translation with Concise explanation of relevance of the Office Action. (14 pages).

*Primary Examiner* — Vanessa T. Luk
(74) *Attorney, Agent, or Firm* — Buchanan Ingersoll & Rooney PC

(57) ABSTRACT

Provided are a steel sheet and a member, having high strength and high delayed fracture resistance, and methods for manufacturing the steel sheet and the member. The steel sheet has a specific chemical composition and a microstructure in which the area fraction of martensite is 95% to 100%, with the balance being one or more of bainite, ferrite, and retained austenite. In the steel sheet, prior-austenite grains have an average grain size of 18 μm or less, 90 mass % or more of the total content of Nb and Ti contained is present as a carbonitride having an equivalent circular diameter of 100 nm or more, and a Nb carbonitride and a Ti carbonitride, having an equivalent circular diameter of 1.0 μm or more, are present at a rate of 800 pieces/mm$^2$ or less in total. The steel sheet has a tensile strength of 1310 MPa or more.

20 Claims, No Drawings

(56) References Cited

FOREIGN PATENT DOCUMENTS

| | | | |
|---|---|---|---|
| WO | 2020090302 | A1 | 5/2020 |
| WO | 2020209275 | A1 | 10/2020 |
| WO | 2021153392 | A1 | 8/2021 |

* cited by examiner

STEEL SHEET, MEMBER, AND METHODS FOR MANUFACTURING THE SAME

CROSS REFERENCE TO RELATED APPLICATIONS

This is the U.S. National Phase application of PCT/JP2021/048106, filed Dec. 24, 2021, which claims priority to Japanese Patent Application No. 2020-216037, filed Dec. 25, 2020, the disclosures of these applications being incorporated herein by reference in their entireties for all purposes.

FIELD OF THE INVENTION

The present invention relates to a high strength steel sheet for cold press forming and a member, which are used in an automobile or the like after being subjected to cold press forming, and methods for manufacturing the steel sheet and the member.

BACKGROUND OF THE INVENTION

In recent years, steel sheets with 1310 MPa or more tensile strength TS have been increasingly used for automotive frame parts for the purpose of weight saving and crashworthiness of automobiles. For bumpers, impact beam parts, and the like, the use of steel sheets with 1.8 GPa or more tensile strength TS has been studied.

Conventionally, high strength steel sheets provided by hot press forming have been used for steel sheets with 1310 MPa or more tensile strength TS, but from the viewpoint of cost and productivity, the use of high strength steel sheets provided by cold pressing is being studied.

When a high strength steel sheet with 1310 MPa or more tensile strength TS is formed into a part by cold pressing, an increase in residual stress within the part and deterioration of delayed fracture resistance of the steel sheet itself may occur to cause a delayed fracture.

The delayed fracture is a phenomenon that occurs as follows: when a part is in a state with a high stress and is placed in a hydrogen entry environment, hydrogen enters a steel sheet forming the part, to reduce interatomic bonding forces or cause local deformation, thus resulting in the formation of microcracks, and the microcracks propagate, thus leading to a fracture.

As a technique for improving such delayed fracture resistance, for example, Patent Literature 1 discloses, on the basis of the results showing that precipitation of fine carbides serving as hydrogen trapping sites improves the delayed fracture resistance, a high strength cold rolled steel sheet having high hydrogen embrittlement resistance and high workability. The steel sheet has a chemical composition containing C: 0.05% to 0.30%, Si: 0% to 2.0%, Mn: more than 0.1% and 2.8% or less, P: 0.1% or less, S: 0.005% or less, N: 0.01% or less, and Al: 0.01% to 0.50% and also containing one or two or more of Nb, Ti, and Zr in an amount of 0.01% or more in total and in such an amount that $[\%C]-[\%Nb]/92.9\times12-[\%Ti]/47.9\times12-[\%Zr]/91.2\times12>0.03$ is satisfied, with the balance being iron and incidental impurities. The steel sheet has a microstructure including tempered martensite with an area fraction of 50% or more (including 100%), with the balance being ferrite. The state of distribution of precipitates in the tempered martensite is such that the number of precipitates having an equivalent circle diameter 1 to 10 nm is 20 or more per $\mu m^2$ of the tempered martensite, and the number of precipitates having an equivalent circle diameter of 20 nm or more and including one or two or more of Nb, Ti, and Zr is 10 or less per $\mu m^2$ of the tempered martensite. The average grain size of ferrite surrounded by a high-angle grain boundary with a misorientation of 150 or more is 5 μm or less.

Patent Literature 2 discloses a high strength heat treated steel having high delayed fracture resistance. The steel contains C: 0.1% to 0.5%, Si: 0.10% to 2%, Mn: 0.44% to 3%, N≤0.008%, and Al: 0.005% to 0.1%, and contains one or two or more of V: 0.05% to 2.82%, Mo: 0.1% or more and less than 3.0%, Ti: 0.03% to 1.24%, and Nb: 0.05% to 0.95%, with the mass % ratio relative to C being $0.5(0.18V+0.06Mo+0.25Ti+0.13Nb)/C$, the balance being Fe and incidental impurities. The steel has a tensile strength of 1200 to 1600 MPa.

PATENT LITERATURE

PTL 1: Japanese Patent No. 4712882
PTL 2: Japanese Patent No. 4427010

SUMMARY OF THE INVENTION

However, the techniques in the related art have yet to be sufficient to ensure high strength and provide high delayed fracture resistance.

The present invention has been made to solve this problem, and an object thereof is to provide a steel sheet and a member, having a tensile strength of 1310 MPa or more (TS 1310 MPa) and high delayed fracture resistance, and methods for manufacturing the steel sheet and the member.

High delayed fracture resistance means that $\sigma_1/\sigma_0$ is 0.80 or more when tensile strength TS is 1310 MPa or more and less than 1500 MPa, $\sigma_1/\sigma_0$ is 0.50 or more when tensile strength TS is 1500 MPa or more and less than 1800 MPa, or $\sigma_1/\sigma_0$ is 0.35 or more when tensile strength TS is 1800 MPa or more, where $\sigma_0$ is a fracture stress measured when immersion is not performed, and $\sigma_1$ is a fracture stress measured after hydrogen is allowed to enter and diffuse by immersion, the fracture stress being measured as follows: conventional strain rate technique (CSRT) specimen (a tensile test specimen having a reduced section with a width of 12.5 mm and a length of 25 mm, both ends of the reduced section having a semicircular notch with a radius of 3 mm) is cut out from a steel sheet at the ¼ position in the width direction of the steel sheet such that a direction perpendicular to the rolling direction is the longitudinal direction of the specimen, a 10 mass % aqueous ammonium thiocyanate solution and a McIlvaine buffer solution having a pH of 3 are mixed at a volume ratio of 1:1, in the resulting solution (pH 3) at 20° C. adjusted such that the fluid volume per $cm^2$ of surface area of the test specimen is 20 ml, the CSRT specimen is immersed for 24 hours to allow hydrogen to enter and diffuse through the test specimen, and immediately after the lapse of 24 hours, a tensile test is carried out at a crosshead speed of 1 mm/min to measure the fracture stress.

To solve the above problem, the present inventors have conducted intensive studies and found that delayed fracture resistance can be greatly improved when the following conditions are all satisfied.

i) The area fraction of martensite is 95% or more.
ii) The average grain size of prior-austenite grains (prior-γ grain size) is 18 μm or less.
iii) Of Nb and Ti contained, 90 mass % or more are present as precipitates having an equivalent circular diameter of 100 nm or more.

iv) A Nb carbonitride and a Ti carbonitride, having an equivalent circular diameter of 1.0 μm or more, are present at a rate of 800 pieces/mm$^2$ or less.

Aspects of the present invention have been completed by further studies based on the above findings, and are as follows.

[1] A steel sheet having a chemical composition containing, in mass %:
C: 0.12% or more and 0.40% or less,
Si: 1.5% or less,
Mn: 1.7% or less,
P: 0.03% or less,
S: less than 0.0020%,
sol. Al: 0.20% or less,
N: 0.005% or less, and
one or more of Nb and Ti with a total content of 0.005% or more and 0.080% or less,
with the balance being Fe and incidental impurities,
in which the steel sheet has a microstructure in which an area fraction of martensite relative to the entire microstructure is 95% or more and 100% or less, with the balance being one or more of bainite, ferrite, and retained austenite,
prior-austenite grains have an average grain size of 18 μm or less,
90 mass % or more of the total content of Nb and Ti contained is present as a carbonitride having an equivalent circular diameter of 100 nm or more, a Nb carbonitride and a Ti carbonitride, having an equivalent circular diameter of 1.0 μm or more, are present at a rate of 800 pieces/mm$^2$ or less in total, and
the steel sheet has a tensile strength of 1310 MPa or more.

[2] The steel sheet according to [1], in which the prior-austenite grains have an average grain size of 10 μm or less.

[3] The steel sheet according to [1] or [2], in which a fracture stress $\sigma_0$ before immersion in a solution containing a 10 mass % aqueous ammonium thiocyanate solution and a McIlvaine buffer solution having a pH of 3,
a fracture stress a, after immersion in the solution, and the tensile strength satisfy (A), (B), or (C) below:
(A) Tensile strength: 1310 MPa or more and less than 1500 MPa, and $\sigma_1/\sigma_0$ is 0.80 or more,
(B) Tensile strength: 1500 MPa or more and less than 1800 MPa, and $\sigma_1/\sigma_0$ is 0.50 or more,
(C) Tensile strength: 1800 MPa or more, and $\sigma_1/\sigma_0$ is 0.35 or more.

[4] The steel sheet according to any one of [1] to [3], in which the chemical composition contains, in mass %, S: less than 0.0010%.

[5] The steel sheet according to any one of [1] to [4], in which the chemical composition further contains, in mass %, B: 0.0100% or less.

[6] The steel sheet according to any one of [1] to [5], in which the chemical composition further contains, in mass %, one or two selected from Cu: 1.0% or less and Ni: 1.0% or less.

[7] The steel sheet according to any one of [1] to [6], in which the chemical composition further contains, in mass %, one or two or more selected from Cr: 1.0% or less, Mo: less than 0.3%, V: 0.5% or less, Zr: 0.2% or less, and W: 0.2% or less.

[8] The steel sheet according to any one of [1] to [7], in which the chemical composition further contains, in mass %, one or two or more selected from Ca: 0.0030% or less, Ce: 0.0030% or less, La: 0.0030% or less, REM (excluding Ce and La): 0.0030% or less, and Mg: 0.0030% or less.

[9] The steel sheet according to any one of [1] to [8], in which the chemical composition further contains, in mass %, one or two selected from Sb: 0.1% or less and Sn: 0.1% or less.

[10] The steel sheet according to any one of [1] to [9], in which a coating layer is disposed on a surface of the steel sheet.

[11] A member obtained by subjecting the steel sheet according to any one of [1] to [10] to at least one of forming and welding.

[12] A method for manufacturing a steel sheet, including:
heating a steel slab having the chemical composition according to any one of [1] and [4] to [9] from 1000° C. to a heat holding temperature of 1250° C. or higher in terms of slab surface temperature at an average heating rate of 10° C./min or less, and holding the steel slab at the heat holding temperature for 30 minutes or more,
then performing hot finish rolling at a finish rolling temperature not lower than an $Ar_3$ temperature,
performing cooling at an average cooling rate of 40° C./s or more in a range from the finish rolling temperature to 650° C.,
then performing cooling and coiling at a coiling temperature of 600° C. or lower to obtain a hot rolled steel sheet,
cold rolling the hot rolled steel sheet at a rolling reduction of 40% or more to obtain a cold rolled steel sheet, and
performing continuous annealing including:
heating the cold rolled steel sheet from 700° C. to an annealing temperature set to 800° C. to 950° C. at an average heating rate of 0.4° C./s or more,
performing holding at the annealing temperature for 600 seconds or less, performing cooling from a cooling start temperature of 680° C. or higher to a cooling stop temperature of 260° C. or lower at an average cooling rate of 70° C./s or more, and
then performing holding at a holding temperature of 150° C. to 260° C. for 20 to 1500 seconds.

[13] The method for manufacturing a steel sheet according to
[12], further including performing coating treatment on a steel sheet surface after the continuous annealing.

[14] A method for manufacturing a member, comprising a step of subjecting a steel sheet manufactured by the method for manufacturing a steel sheet according to [12] or [13] to at least one of forming and welding.

According to aspects of the present invention, a steel sheet and a member, having high strength and high delayed fracture resistance, and methods for manufacturing the steel sheet and the member are provided.

DETAILED DESCRIPTION OF EMBODIMENTS OF THE INVENTION

Hereinafter, an embodiment of the present invention will be described.

A steel sheet according to aspects of the present invention has a chemical composition containing, in mass %, C: 0.12% or more and 0.40% or less, Si: 1.5% or less, Mn: 1.7% or less, P: 0.03% or less, S: less than 0.0020%, sol. Al: 0.20% or less, N: 0.005% or less, and one or more of Nb and Ti with a total content of 0.005% or more and 0.080% or less, with the balance being Fe and incidental impurities. The steel sheet has a microstructure in which an area fraction of martensite relative to the entire microstructure is 95% or more and 100% or less, with the balance being one or more of bainite, ferrite, and retained austenite; prior-austenite grains (hereinafter also referred to as prior-γ grains) have an average grain size (prior-γ grain size) of 18 μm or less; 90 mass % or more of the total content of Nb and Ti contained is present as a carbonitride having an equivalent circular diameter of 100 nm or more; a Nb carbonitride and a Ti carbonitride, having an equivalent circular diameter of 1.0 μm or more, are present at a rate of 800 pieces/$mm^2$ or less in total; and the steel sheet has a tensile strength of 1310 MPa or more.

Chemical Composition

The reason for the limitation of the range of the chemical composition of the steel sheet according to aspects of the present invention will be described below. It should be noted that % related to a component content means "mass %".

C: 0.12% or More and 0.40% or Less

C is contained to improve hardenability to provide a martensite steel microstructure and from the viewpoint of increasing the strength of martensite to achieve a tensile strength of 1310 MPa or more (hereinafter also referred to as TS≥1310 MPa). Excessively added C forms iron carbide and segregates at grain boundaries, causing worsening of delayed fracture resistance. Therefore, the C content is limited to be in the range of 0.12% or more and 0.40% or less necessary to achieve the strength of steel. The C content is preferably 0.37% or less.

Si: 1.5% or Less

Si is contained as an element for strengthening through solid solution strengthening and from the viewpoint of suppressing the formation of film-shaped carbide during tempering in the temperature range of 200° C. or higher to improve delayed fracture resistance. Si is contained also from the viewpoint of reducing Mn segregation at a central portion in the thickness direction to suppress the formation of MnS. Furthermore, Si is contained to suppress decarburization and deboronization due to oxidation of a surface layer during annealing on a continuous annealing line (CAL). Although the lower limit of the Si content is not specified, Si is desirably contained in an amount of 0.02% or more from the viewpoint of producing the above effect. The Si content is preferably 0.10% or more, more preferably 0.20% or more.

However, an excessively high Si content results in a large amount of Si segregation, leading to deterioration of delayed fracture resistance. The excessively high Si content also leads to a significant increase in rolling load in hot rolling and cold rolling and a decrease in toughness. Therefore, the Si content is 1.5% or less (including 0%). The Si content is preferably 1.2% or less, more preferably 1.0% or less.

Mn: 1.7% or Less

Mn is contained to adjust the area fraction of martensite to be in a predetermined range in order to improve the hardenability of steel and achieve desired strength. However, excessive addition of Mn results in segregation of Mn to reduce workability and weldability. Therefore, the Mn content is 1.7% or less. The Mn content is preferably 1.5% or less. The Mn content is more preferably 1.4% or less. The Mn content is still more preferably 1.2% or less. To stably achieve the predetermined area fraction of martensite on an industrial scale, Mn is preferably contained in an amount of 0.2% or more. The Mn content is more preferably 0.4% or more, still more preferably 0.6% or more.

P: 0.03% or Less

P is an element that strengthens steel, but when the content thereof is high, delayed fracture resistance and spot weldability significantly deteriorate. Therefore, the P content is 0.03% or less. From the above viewpoint, the P content is preferably 0.004% or less. Although the lower limit of the P content is not specified, the lower limit that is industrially feasible at present is 0.002%.

S: Less than 0.0020%

S forms MnS and greatly reduces delayed fracture resistance at a sheared edge surface. Therefore, the S content needs to be at least less than 0.0020% to reduce MnS. From the viewpoint of improving delayed fracture resistance, the S content is preferably less than 0.0010%. The S content is more preferably 0.0004% or less. Although the lower limit is not specified, the lower limit that is industrially feasible at present is 0.0002%.

Sol. Al: 0.20% or Less

Al is contained to perform sufficient deoxidization and reduce inclusions in steel. Although the lower limit of the sol. Al content is not particularly specified, the sol. Al content is desirably 0.005% or more in order to stably perform deoxidization. The sol. Al content is more desirably 0.01% or more. The sol. Al content is preferably 0.02% or more. However, when the sol. Al content exceeds 0.20%, cementite formed during coiling is less easily dissolved in an annealing process, and delayed fracture resistance deteriorates. Therefore, the sol. Al content is 0.20% or less. The sol. Al content is preferably 0.10% or less, more preferably 0.05% or less.

N: 0.005% or Less

N is an element that forms nitride and carbonitride inclusions such as TiN, (Nb, Ti) (C, N), and AlN in steel, and delayed fracture resistance deteriorates through the formation of these inclusions. These inclusions inhibit the achievement of the steel microstructure required in accordance with aspects of the present invention and have an adverse effect on the delayed fracture resistance at a sheared edge surface. To minimize such an adverse effect, the N content is 0.005% or less. The N content is preferably 0.0040% or less. Although the lower limit is not specified, the lower limit that is industrially feasible at present is 0.0006%.

One or More of Nb and Ti with Total Content of 0.005% or More and 0.080% or Less Nb and Ti contribute to increasing strength through the refinement of the internal structure of martensite and also improve delayed fracture resistance by reducing the prior-γ grain size. From this viewpoint, one or more of Nb and Ti are contained with a total content of 0.005% or more. The total content of Nb and Ti is preferably 0.010% or more, more preferably 0.020% or more. However, when the total content of one or more of Nb and Ti exceeds 0.080%, Nb and Ti do not completely dissolve in slab reheating, increasing coarse inclusion particles such as TiN, Ti(C, N), NbN, Nb(C, N), and (Nb, Ti) (C, N), and delayed fracture resistance rather deteriorates. Therefore, the upper limit of the total content of Nb and Ti is 0.080%. The total content of Nb and Ti is preferably 0.07% or less, more preferably 0.06% or less.

The steel sheet according to aspects of the present invention has a chemical composition containing the components described above and Fe (iron) and incidental impurities constituting the balance. In particular, a steel sheet according to an embodiment of the present invention preferably has a chemical composition containing the components described above with the balance being Fe and incidental impurities.

In addition to the base components described above, the chemical composition of the steel sheet according to aspects of the present invention may contain the following optional elements. In accordance with aspects of the present invention, when any of these optional components is contained in an amount less than a preferred lower limit described below, the element is regarded as being contained as an incidental impurity.

B: 0.0100% or Less

B is an element that improves the hardenability of steel and offers an advantage in that martensite having a predetermined area fraction is formed even when the Mn content is low. To produce this effect of B, the B content is preferably 0.0002% or more, more preferably 0.0005% or more. The B content is still more preferably 0.0010% or more. From the viewpoint of immobilizing N, B is desirably added in combination with 0.002% or more of Ti. However, when B is contained in an amount exceeding 0.0100%, not only its effect plateaus, but also the dissolution rate of cementite during annealing may be retarded to leave behind undissolved cementite, thus deteriorating the delayed fracture resistance at a sheared edge surface. For these reasons, when B is contained, the B content is desirably 0.0100% or less. The B content is preferably 0.0065% or less, more preferably 0.0030% or less, still more preferably 0.0025% or less.

Cu: 1.0% or Less

Cu improves the corrosion resistance of automobiles under service conditions. When Cu is contained, corrosion products thereof cover the surface of the steel sheet to inhibit hydrogen entry into the steel sheet. Cu is an element that is unintentionally incorporated when scrap metal is utilized as a raw material, and permitting the unintentional incorporation of Cu enables recycled materials to be used as raw materials, thus reducing the manufacturing cost. From the above viewpoints, Cu is preferably contained in an amount of 0.01% or more, and further from the viewpoint of improving delayed fracture resistance, Cu is desirably contained in an amount of 0.05% or more. The Cu content is more preferably 0.10% or more. However, since an excessively high Cu content may cause a surface defect, the Cu content is desirably 1.0% or less. For these reasons, when Cu is contained, the Cu content is 1.0% or less. The Cu content is more preferably 0.50% or less, still more preferably 0.30% or less.

Ni: 1.0% or Less

Ni is also an element that improves corrosion resistance. In addition, Ni reduces surface defects that are likely to occur when Cu is contained. Therefore, from the above viewpoints, Ni is desirably contained in an amount of 0.01% or more. The Ni content is more preferably 0.05% or more, still more preferably 0.10% or more. However, an excessively high Ni content results in uniform scale formation in a heating furnace to cause a surface defect, and also results in a significantly increased cost. Therefore, when Ni is contained, the Ni content is 1.0% or less. The Ni content is more preferably 0.50% or less, still more preferably 0.30% or less.

Cr: 1.0% or Less

Cr can be added to produce the effect of improving the hardenability of steel. To produce this effect, Cr is preferably contained in an amount of 0.01% or more. The Cr content is more preferably 0.05% or more, still more preferably 0.10% or more. However, a Cr content exceeding 1.0% retards the dissolution rate of cementite during annealing to leave behind undissolved cementite, thus deteriorating the delayed fracture resistance at a sheared edge surface. The Cr content exceeding 1.0% also deteriorates pitting corrosion resistance, and further deteriorates chemical convertibility. Thus, when Cr is contained, the Cr content is 1.0% or less. The delayed fracture resistance, the pitting corrosion resistance, and the chemical convertibility all tend to begin deteriorating when the Cr content exceeds 0.2%, and thus from the viewpoint of preventing these deteriorations, the Cr content is more preferably 0.2% or less.

Mo: Less than 0.3%

Mo can be added for the purpose of producing the effect of improving the hardenability of steel, the effect of forming Mo-containing fine carbide serving as a hydrogen trapping site, and the effect of improving delayed fracture resistance by refining martensite. When Nb and Ti are added in large amounts, coarse precipitates thereof are formed, and delayed fracture resistance rather deteriorates. However, the dissolution limit of Mo is higher than those of Nb and Ti. When Mo is added in combination with Nb and Ti, their complex fine precipitates are formed to refine the microstructure. Therefore, adding Mo in combination with small amounts of Nb and Ti enables dispersion of a large number of fine carbides while refining the microstructure without leaving behind coarse precipitates, thus improving delayed fracture resistance. To produce this effect, Mo is desirably contained in an amount of 0.01% or more. The Mo content is more preferably 0.03% or more, still more preferably 0.05% or more. However, when Mo is contained in an amount of 0.3% or more, chemical convertibility deteriorates. Thus, when Mo is contained, the Mo content is less than 0.3%. The Mo content is preferably 0.2% or less.

V: 0.5% or Less

V can be added for the purpose of producing the effect of improving the hardenability of steel, the effect of forming V-containing fine carbide serving as a hydrogen trapping site, and the effect of improving delayed fracture resistance by refining martensite. To produce these effects, the V content is desirably 0.003% or more. The V content is more preferably 0.03% or more, still more preferably 0.05% or more. However, when V is contained in an amount exceeding 0.5%, castability significantly deteriorates. Thus, when V is contained, the V content is 0.5% or less. The V content is more preferably 0.3% or less, still more preferably 0.2% or less. Furthermore, the V content is preferably 0.1% or less.

Zr: 0.2% or Less

Zr contributes to increasing strength through the reduction in prior-γ grain size and consequent refinement of the internal structure of martensite and also improves delayed fracture resistance. In addition, Zr increases strength and improves delayed fracture resistance through the formation of fine Zr carbide and carbonitride serving as hydrogen trapping sites. In addition, Zr improves castability. From these viewpoints, the Zr content is desirably 0.005% or more. The Zr content is more preferably 0.010% or more, still more preferably 0.015% or more. However, when Zr is added in a large amount, the number of ZrN and ZrS coarse precipitates that remain undissolved during slab heating in the hot rolling step increases, deteriorating the delayed fracture resistance at a sheared edge surface. Thus, when Zr is contained, the Zr content is 0.2% or less. The Zr content is more preferably 0.1% or less, still more preferably 0.04% or less.

W: 0.2% or Less

W contributes to increasing strength and improving delayed fracture resistance through the formation of fine W carbide and carbonitride serving as hydrogen trapping sites. From this viewpoint, W is desirably contained in an amount of 0.005% or more. The W content is more preferably 0.010% or more, still more preferably 0.030% or more. However, when W is contained in a large amount, the number of coarse precipitates that remain undissolved during slab heating in the hot rolling step increases, deteriorating the delayed fracture resistance at a sheared edge surface. Thus, when W is contained, the W content is 0.2% or less. The W content is more preferably 0.1% or less.

Ca: 0.0030% or Less

Ca immobilizes S by forming CaS to improve delayed fracture resistance. To produce this effect, Ca is desirably contained in an amount of 0.0002% or more. The Ca content is more preferably 0.0005% or more, still more preferably 0.0010% or more. However, when Ca is added in a large amount, surface quality and bendability are deteriorated, and thus the Ca content is preferably 0.0030% or less. For these reasons, when Ca is contained, the Ca content is 0.0030% or less. The Ca content is more preferably 0.0025% or less, still more preferably 0.0020% or less.

Ce: 0.0030% or Less

Ce also immobilizes S to improve delayed fracture resistance. To produce this effect, Ce is desirably contained in an amount of 0.0002% or more. The Ce content is more preferably 0.0003% or more, still more preferably 0.0005% or more. However, when Ce is added in a large amount, surface quality and bendability are deteriorated, and thus the Ce content is desirably 0.0030% or less. For these reasons, when Ce is contained, the Ce content is 0.0030% or less. The Ce content is more preferably 0.0020% or less, still more preferably 0.0015% or less.

La: 0.0030% or Less

La also immobilizes S to improve delayed fracture resistance. To produce this effect, La is desirably contained in an amount of 0.0002% or more. The La content is more preferably 0.0005% or more, still more preferably 0.0010% or more. However, when La is added in a large amount, surface quality and bendability are deteriorated, and thus the La content is desirably 0.0030% or less. For these reasons, when La is contained, the La content is 0.0030% or less. The La content is more preferably 0.0020% or less, still more preferably 0.0015% or less.

REM: 0.0030% or Less

REM also immobilizes S to improve delayed fracture resistance. To produce this effect, REM is desirably contained in an amount of 0.0002% or more. The REM content is more preferably 0.0003% or more, still more preferably 0.0005% or more. However, when REM is added in a large amount, surface quality and bendability are deteriorated, and thus the REM content is desirably 0.0030% or less. For these reasons, when REM is contained, the REM content is 0.0030% or less. The REM content is more preferably 0.0020% or less, still more preferably 0.0015% or less.

The term "REM" as used herein refers to scandium (Sc) with atomic number 21, yttrium (Y) with atomic number 39, and lanthanide elements from lanthanum (La) with atomic number 57 to lutetium (Lu) with atomic number 71 excluding Ce and La. The term "REM concentration" as used herein refers to a total content of one or two or more elements selected from REM above.

Mg: 0.0030% or Less

Mg immobilizes O by forming MgO to improve delayed fracture resistance. To produce this effect, Mg is desirably contained in an amount of 0.0002% or more. The Mg content is more preferably 0.0005% or more, still more preferably 0.0010% or more. However, when Mg is added in a large amount, surface quality and bendability are deteriorated, and thus the Mg content is desirably 0.0030% or less. For these reasons, when Mg is contained, the Mg content is 0.0030% or less. The Mg content is more preferably 0.0020% or less, still more preferably 0.0015% or less.

Sb: 0.1% or Less

Sb suppresses oxidation and nitridation of the surface layer to thereby suppress decreases in C and B. The suppression of decreases in C and B leads to suppression of ferrite formation in the surface layer, contributing to increasing strength and improving delayed fracture resistance. From this viewpoint, the Sb content is desirably 0.002% or more. The Sb content is more preferably 0.004% or more, still more preferably 0.006% or more. However, when the Sb content exceeds 0.1%, castability deteriorates, and Sb segregates at prior-γ grain boundaries to deteriorate the delayed fracture resistance at a sheared edge surface. Thus, the Sb content is desirably 0.1% or less. For these reasons, when Sb is contained, the Sb content is 0.1% or less. The Sb content is more preferably 0.05% or less, still more preferably 0.02% or less.

Sn: 0.1% or Less

Sn suppresses oxidation and nitridation of the surface layer to thereby suppress decreases in C and B contents in the surface layer. The suppression of decreases in C and B leads to suppression of ferrite formation in the surface layer, contributing to increasing strength and improving delayed fracture resistance. From this viewpoint, the Sn content is desirably 0.002% or more. The Sn content is preferably 0.003% or more. However, when the Sn content exceeds 0.1%, castability deteriorates, and Sn segregates at prior-γ grain boundaries to deteriorate the delayed fracture resistance at a sheared edge surface. Thus, when Sn is contained, the Sn content is 0.1% or less. The Sn content is more preferably 0.05% or less, still more preferably 0.01% or less.

Steel Microstructure

A steel microstructure of the steel sheet according to aspects of the present invention has the following features.

(Feature 1) The area fraction of martensite relative to the entire microstructure is 95% or more and 100% or less, with the balance being one or more of bainite, ferrite, and retained austenite.

(Feature 2) Prior-austenite grains have an average grain size of 18 μm or less.

(Feature 3) 90 mass % or more of the total content of Nb and Ti contained is present as a carbonitride having an equivalent circular diameter of 100 nm or more.

(Feature 4) A Nb carbonitride and a Ti carbonitride, having an equivalent circular diameter of 1.0 μm or more, are present at a rate of 800 pieces/mm$^2$ or less.

These features will hereinafter be described.

(Feature 1) The area fraction of martensite relative to the entire microstructure is 95% or more and 100% or less, with the balance being one or more of bainite, ferrite, and retained austenite.

To achieve both high strength, that is, TS≥1310 MPa, and high delayed fracture resistance, the total area fraction of martensite in the steel microstructure is 95% or more, more preferably 99% or more, still more preferably 100%. When microstructures other than martensite and bainite are included, the balance is constituted by ferrite and retained austenite (retained γ). The portion other than these microstructures is constituted by traces of carbides, sulfides, nitrides, and oxides. The martensite also includes martensite that has not been self-tempered during continuous cooling or not been tempered by being held at about 150° C. or higher for a certain period of time. The area fraction of martensite may be 100% with no balance.

(Feature 2) Prior-austenite grains have an average grain size of 18 μm or less.

The delayed fracture surface of steel whose parent phase is martensite is often an intergranular fracture surface, and the origin of a delayed fracture and the crack growth path in the early stage of the delayed fracture are considered to lie on a prior-γ grain boundary. Reduction in prior-γ grain size suppresses intergranular fracture to significantly improve delayed fracture resistance. The mechanism is probably as follows: reduction in prior-γ grain size increases the volume fraction of prior-γ grain boundaries and decreases the concentration of grain boundary embrittling elements such as P on grain boundaries. From the viewpoint of delayed fracture resistance, the average grain size of prior-austenite grains (average prior-γ grain size) is 18 μm or less. The average grain size is preferably 10 μm or less, more preferably 7 μm or less, still more preferably 5 μm or less.

(Feature 3) 90 mass % or more of the total content of Nb and Ti contained is present as a carbonitride having an equivalent circular diameter of 100 nm or more.

It is thought that Nb and Ti are precipitated in the hot rolling step and the coiling step and produce a pinning effect to reduce the prior-γ grain size in the coiling step and the annealing step, and form fine precipitates of 50 nm or less to non-diffusively trap hydrogen in steel in the interface between the precipitates and the parent phase, thereby effectively helping suppress delayed fracture. However, in the case of a steel sheet for cold pressing including a continuous annealing step, Nb-based precipitates and Ti-based precipitates are coarsened, and thus large amounts of Nb and Ti need to be added in order to trap hydrogen in an amount sufficient to suppress delayed fracture. In addition, precipitates having hydrogen trapping ability may increase the amount of hydrogen that enters steel to rather worsen delayed fracture resistance.

Meanwhile, the present inventors have found that Nb-based precipitates and Ti-based precipitates of 100 nm or more, which have been thought not to have hydrogen trapping ability and to be ineffective in suppressing delayed fracture, significantly improve delayed fracture resistance. This effect is apparent when 90 mass % or more of the total content of Nb and Ti in steel are constituted by Nb and Ti that form carbonitrides of 100 nm or more. Although the mechanism is not necessarily clear, the present inventors consider that Nb- and Ti-based carbonitrides of 100 nm or more dispersed in steel affect delayed fracture crack growth to suppress delayed fracture.

For these reasons, in the steel sheet according to aspects of the present invention, 90 mass % or more of the total content of Nb and Ti contained is present as a carbonitride having an equivalent circular diameter of 100 nm or more.

Although the upper limit of the carbonitride size is not particularly specified, Nb- and Ti-based precipitates newly precipitated in the hot rolling step and the coiling step often have a size of 500 nm or less. Thus, in accordance with aspects of the present invention, the carbonitrides of Nb and Ti described above are preferably carbonitrides having an equivalent circular diameter of 100 nm or more and 500 nm or less.

(Feature 4) A Nb carbonitride and a Ti carbonitride, having an equivalent circular diameter of 1.0 μm or more, are present at a rate of 800 pieces/mm$^2$ or less in total. In steel in which the prior-γ grain size is sufficiently fine and intergranular fracture is suppressed, a delayed fracture originates from an inclusion of 1.0 μm or more in the steel, and thus it is important to reduce inclusions of 1.0 μm or more. Nb- and Ti-based precipitates have high dissolution temperatures and account for a particularly large proportion of inclusions of 1.0 μm or more. Thus, in accordance with aspects of the present invention, to improve delayed fracture resistance, a Nb carbonitride and a Ti carbonitride, having an equivalent circular diameter of 1.0 μm or more, are present at a rate of 800 pieces/mm$^2$ or less in total, more preferably 100 pieces/mm$^2$ or less, still more preferably 50 pieces/mm$^2$ or less. In accordance with aspects of the present invention, the Nb carbonitride and the Ti carbonitride, having an equivalent circular diameter of 1.0 μm or more, are often present at a rate of 5 pieces/mm$^2$ or more in total.

Methods of measuring the features of the steel microstructure above will be described.

The area fractions of martensite, bainite, and ferrite are measured in the following manner. An L section (a section parallel to the rolling direction and perpendicular to the steel sheet surface) of the steel sheet is polished and then etched with nital, four view areas are observed under SEM at a magnification of 2000× at a position ¼ thickness deep from the steel sheet surface, and microstructure images captured are subjected to image analysis. Here, martensite and bainite are microstructures exhibiting a gray or white color in SEM. By contrast, ferrite is a region exhibiting a black color in SEM. Martensite and bainite include traces of carbides, nitrides, sulfides, and oxides, but since it is difficult to exclude them, area fractions of regions including them are used as the area fractions of martensite and bainite.

Here, bainite has the following features. Specifically, bainite is in the form of a plate having an aspect ratio of 2.5 or more and is a microstructure that is somewhat blacker than martensite. The plate has a width (breadth) of 0.3 to 1.7 μm. The distribution density of a carbide having a diameter of 10 to 200 nm inside bainite is 0 to 3 pieces/μm$^2$.

Retained austenite (retained γ) is measured by chemically polishing a surface of the steel sheet by 200 μm with oxalic acid and analyzing the resulting surface by an X-ray diffraction intensity method. Integral intensities of peaks of (200) α, (211) α, (220) α, (200)γ, (220)γ, and (311)γ diffraction planes measured with Mo-Kα radiation are used to make calculations.

The average grain size of prior-austenite grains (prior-γ grain size) is measured in the following manner. An L section (a section parallel to the rolling direction and perpendicular to the steel sheet surface) of the steel sheet is polished and then etched with a chemical solution (e.g., a saturated aqueous picric acid solution or a saturated aqueous picric acid solution with ferric chloride added) for etching prior-γ grain boundaries, four view areas are observed under a light microscope at a magnification of 500× at a position ¼ thickness deep from the steel sheet surface, 15 lines are drawn at intervals of 10 μm or more in actual length in each of the thickness direction and the rolling direction in the images obtained, the number of intersections of grain boundaries and the lines is counted. Furthermore, the total line length is divided by the number of intersections, and the value obtained is multiplied by 1.13, whereby the prior-γ grain size (average grain size of prior-austenite grains) can be measured.

The percentage of Nb and Ti forming carbonitrides having an equivalent circular diameter of 100 nm or more among Nb and Ti contained can be measured by the following method.

After a predetermined amount of sample is electrolyzed in an electrolyte, a sample piece is taken out of the electrolyte and immersed in a solution having dispersibility. Subsequently, precipitates contained in the solution are filtered through a filter with a pore size of 100 nm. The precipitates collected on the filter with a pore size of 100 nm are the carbonitrides having a diameter (equivalent circular diameter) of 100 nm or more. The residue on the filter and the filtrate obtained by the filtering were analyzed for Nb amount and Ti amount to determine the contents of Nb and Ti in the carbonitrides having a diameter of 100 nm or more and carbonitrides having a diameter of less than 100 nm. For the analysis, inductively coupled plasma (ICP) emission spectroscopic analysis can be used. The percentage of the total amount of Nb and Ti in the carbonitrides having a diameter of 100 nm or more to the total amount of Nb and Ti in steel is then calculated.

The number (distribution density) of the Nb carbonitride and the Ti carbonitride per $mm^2$ can be determined as follows: after an L section (a section parallel to the rolling direction and perpendicular to the steel sheet surface) of the steel sheet is polished, in a region extending from the ⅕ thickness position to the ⅘ thickness position of the steel sheet without etching, that is, a region extending from a position ⅕ deep from the steel sheet surface in the thickness direction to the middle of the thickness and further to the ⅘ position, regions of 2 $mm^2$ or more are continuously photographed by SEM, and the number of the carbonitrides are calculated in the SEM photographs captured. Here, the SEM images are preferably backscattered electron images. The magnification in the photographing may be 2000×. However, when it is difficult to accurately discern the size of precipitates at a magnification of 2000×, individual inclusion particles may be enlarged to 10000 times as appropriate to demarcate the carbonitrides.

Tensile Strength (TS): 1310 MPa or More

The deterioration of delayed fracture resistance is significantly apparent when the tensile strength of a material is 1310 MPa or more. One of the features according to aspects of the present invention is that the delayed fracture resistance is good even at 1310 MPa or more. Therefore, the tensile strength is 1310 MPa or more in accordance with aspects of the present invention. The tensile strength of the steel sheet according to aspects of the present invention may be 2100 MPa or less.

The tensile strength can be measured by a tensile test in accordance with JIS Z 2241 using a JIS No. 5 tensile test specimen cut out at a coil width ¼ position such that a direction perpendicular to the rolling direction is the longitudinal direction of the specimen.

In the steel sheet according to aspects of the present invention, $\sigma_0$, $\sigma_1$, and a tensile strength preferably satisfy (A), (B), or (C) below, where $\sigma_0$ is a fracture stress before immersion in a solution containing a 10 mass % aqueous ammonium thiocyanate solution and a McIlvaine buffer solution having a pH of 3, and $\sigma_1$ is a fracture stress after immersion in the solution.

(A) Tensile strength: 1310 MPa or more and less than 1500 MPa, and $\sigma_0/\sigma_1$ is 0.80 or more, (B) Tensile strength: 1500 MPa or more and less than 1800 MPa, and $\sigma_1/\sigma_0$ is 0.50 or more, (C) Tensile strength: 1800 MPa or more, and $\sigma_1/\sigma_0$ is 0.35 or more.

The fracture stress $\sigma_0$ and the fracture stress $\sigma_1$ can be determined using a conventional strain rate technique (CSRT) specimen cut out from the steel sheet at the ¼ position in the width direction of the steel sheet such that a direction perpendicular to the rolling direction is the longitudinal direction of the specimen. The CSRT specimen may be a tensile test specimen having a reduced section with a width of 12.5 mm and a length of 25 mm, both ends of the reduced section having a semicircular notch with a radius of 3 mm.

The fracture stress $\sigma_1$ can be measured as follows: a 10 mass % aqueous ammonium thiocyanate solution and a McIlvaine buffer solution having a pH of 3 are mixed at 1:1, in the resulting solution at 20° C. adjusted such that the fluid volume per $cm^2$ of surface area of the test specimen is 20 ml, the CSRT specimen is immersed for 24 hours to allow hydrogen to enter and diffuse through the test specimen, and immediately after the lapse of 24 hours, a tensile test is carried out at a crosshead speed of 1 mm/min. The fracture stress $\sigma_0$ can be determined under the same conditions except that the immersion is not performed.

The steel sheet according to aspects of the present invention described above may be a steel sheet having a coating layer on its surface. The coating layer may be formed of Zn or other metal. The coating layer may be a hot-dip coating layer or an electroplated coating layer.

Next, a method for manufacturing the steel sheet according to aspects of the present invention will be described.

The method for manufacturing the steel sheet according to aspects of the present invention is a method for manufacturing a steel sheet, including heating a steel slab having the above chemical composition from 1000° C. to a heat holding temperature of 1250° C. or higher in terms of slab surface temperature at an average heating rate of 10° C./min or less, and holding the steel slab at the heat holding temperature for 30 minutes or more, then performing hot finish rolling at a finish rolling temperature not lower than an $Ar_3$ temperature, performing cooling at an average cooling rate of 40° C./s or more in the range from the finish rolling temperature to 650° C., then performing cooling and coiling at a coiling temperature of 600° C. or lower to obtain a hot rolled steel sheet, cold rolling the hot rolled steel sheet at a rolling reduction of 40% or more to obtain a cold rolled steel sheet, and performing continuous annealing including heating the cold rolled steel sheet from 700° C. to an annealing temperature set to 800° C. to 950° C. at an average heating rate of 0.4° C./s or more, performing holding at the annealing temperature for 600 seconds or less, performing cooling from a cooling start temperature of 680° C. or higher to a cooling stop temperature of 260° C. or lower at an average cooling rate of 70° C./s or more, performing reheating as needed, and then performing holding at a holding temperature of 150° C. to 260° C. for 20 to 1500 seconds.

Hot Rolling

In the slab heating before the hot rolling, dissolution of sulfides is promoted to reduce the size and number of inclusions by setting the average heating rate from 1000° C. to a heat holding temperature of 1250° C. or higher to 10° C./min or less. Since Nb and Ti have high dissolution temperatures, dissolution of Nb and Ti is promoted to reduce the size and number of inclusions by setting the heat holding temperature to 1250° C. or higher in terms of slab surface temperature and the holding time to 30 minutes or more. The heat holding temperature is preferably 1300° C. or higher, more preferably 1350° C. or higher. The average heating rate from 1000° C. to a heat holding temperature of 1250° C. or higher is preferably 2° C./min or more. The heat holding temperature in terms of slab surface temperature is preferably 1380° C. or lower. The time to hold the slab at the heat holding temperature is preferably 250 minutes or less.

Here, the average heating rate is expressed as "(temperature (° C.) at completion of slab heating−temperature (° C.) at start of slab heating)/heating time (min) from start of heating to completion of heating".

When the finish rolling temperature is lower than the $Ar_3$ temperature in the hot finish rolling, ferrite is formed to cause stress concentration at ferrite interfaces in a final product, thus promoting delayed fracture. Therefore, the finish rolling temperature (FT) is not lower than the $Ar_3$ temperature.

As cooling after the hot finish rolling, cooling at an average cooling rate of 40° C./s or more is performed in the range from the finish rolling temperature to 650° C. When the average cooling rate is less than 40° C./s, Nb and Ti carbonitrides are coarsened to increase carbonitrides having an equivalent circular diameter of 1.0 μm or more, and desired delayed fracture resistance cannot be obtained. The average cooling rate is preferably 250° C./s or less, more preferably 200° C./s or less.

The average cooling rate is expressed as "(temperature (finish rolling temperature) (° C.) at start of cooling-temperature (° C.) at completion of cooling (650° C.))/cooling time (s) from start of cooling to completion of cooling".

When the coiling temperature is higher than 600° C., only the coarsening of Nb- and Ti-based precipitates precipitated in fine austenite regions proceeds, so that coarse precipitates increase to reduce delayed fracture resistance. Therefore, the coiling temperature is 600° C. or lower.

The $Ar_3$ temperature is determined as follows.

$$Ar_3\ \text{temperature}(^\circ\text{C.}) = 910 - 310\times[C] - 80\times[Mn] - 20\times[Cu] - 15\times[Cr] - 55\times[Ni] - 80\times[Mo]$$

(In the formula, [M] represents a content (mass %) of an element M in the steel slab, and the value of an element not contained is zero (0).)

Cold Rolling

When the rolling reduction (cold rolling reduction) is 40% or more in the cold rolling, the recrystallization behavior and texture orientation in the subsequent continuous annealing can be stabilized. When the rolling reduction is less than 40%, some austenite grains may be coarsened during annealing to decrease the strength. The cold rolling reduction is preferably 80% or less. The cold rolling reduction is more preferably 70% or less.

Continuous Annealing

The cold rolled steel sheet is subjected to annealing on a continuous annealing line (CAL) and, when necessary, tempering and temper rolling.

Increasing the heating rate is effective in reducing the prior-γ grain size, and the average heating rate at 700° C. or higher for reducing the prior-γ grain size to 10 μm or less is 0.4° C./s or more.

The average heating rate here is expressed as "(annealing temperature (° C.) described below −700 (° C.))/heating time (s) from 700° C. to annealing temperature".

To sufficiently reduce carbides such as cementite particles left undissolved after annealing, the annealing is performed at high temperature for a long period of time. Specifically, the annealing temperature needs to be 800° C. or higher. Annealing at higher than 950° C. results in an excessively large prior-γ grain size, and thus the annealing temperature is 950° C. or lower, more preferably 900° C. or lower. A long soaking time (holding time) also results in an excessively large prior-γ grain size, and thus soaking (holding) is performed for 600 seconds or less.

To reduce ferrite and retained γ to achieve a martensite area fraction of 95% or more, cooling (rapid cooling) needs to be performed from a cooling start temperature of 680° C. or higher to a cooling stop temperature of 260° C. or lower at an average cooling rate of 70° C./s or more. Preferably, cooling is performed from a cooling start temperature at an average cooling rate of 700° C./s or more.

When the cooling start temperature is lower than 680° C., ferrite is formed in a large amount, and, in addition, carbon is concentrated in austenite (γ) to lower the Ms temperature, resulting in an increase in untempered martensite (fresh martensite). When the cooling rate is low, upper and lower bainite may be formed to increase the amount of retained austenite (retained γ) and fresh martensite. When the cooling stop temperature is higher than 260° C., upper and lower bainite may be formed to increase the amount of retained γ and fresh martensite. The acceptable limit of the area fraction of fresh martensite in martensite is 5% relative to 100% of martensite, and the amount of fresh martensite falls within this range when the above-described conditions are employed.

For the above reason, the cooling start temperature is 680° C. or higher. The upper limit of the cooling start temperature is preferably 940° C.

For the above reason, the cooling stop temperature is 260° C. or lower. The lower limit of the cooling stop temperature is preferably 150° C.

The upper limit of the average cooling rate is preferably 1000° C./s.

The average cooling rate here is expressed as "(cooling start temperature (° C.)−cooling stop temperature (° C.))/cooling time (s) from start of cooling to stop of cooling".

Carbides distributed inside martensite are formed during holding in a low temperature range after quenching. For the achievement of high delayed fracture resistance and a tensile strength of 1310 MPa or more (TS≥1310 MPa), the formation of the carbides needs to be appropriately controlled.

To achieve this, it is necessary to control the holding time to 20 to 1500 seconds at a holding temperature of 150° C. to 260° C.

When the holding temperature is lower than its lower limit 150° C. or the holding time is short, the carbide distribution density in the transformation phase is insufficient, deteriorating delayed fracture resistance. When the holding temperature is higher than its upper limit 260° C., carbides in grains and at block grain boundaries may be noticeably coarsened, deteriorating delayed fracture resistance.

The steel sheet thus obtained may be subjected to skin pass rolling from the viewpoint of stabilizing the press formability by, for example, adjusting the surface roughness and flattening the sheet shape. In this case, the skin pass elongation is preferably 0.1% to 0.6%. In this case, from the viewpoint of shape flattening, it is preferable to use a dull roll as a skin pass roll and adjust the roughness Ra of the steel sheet to 0.8 to 1.8 μm.

The steel sheet obtained may be subjected to coating treatment. The coating treatment provides a steel sheet having a coating layer on its surface. The type of coating treatment is not particularly limited, and may be hot-dip coating, electroplating, or coating treatment involving alloying after hot-dip coating. When the above skin pass rolling is performed in the case where coating treatment is performed, the skin pass rolling is performed after the coating treatment.

As described above, aspects of the present invention provide a high strength cold rolled steel sheet with greatly improved delayed fracture resistance, and using the high strength steel sheet contributes to improvement of part strength and weight saving. The steel sheet according to aspects of the present invention preferably has a thickness of 0.5 mm or more. The steel sheet according to aspects of the present invention preferably has a thickness of 2.0 mm or less.

Next, a member according to aspects of the present invention and a method for manufacturing the member will be described.

The member according to aspects of the present invention is obtained by subjecting the steel sheet according to aspects of the present invention to at least one of forming and welding. The method for manufacturing the member according to aspects of the present invention includes a step of subjecting a steel sheet manufactured by the method for manufacturing a steel sheet according to aspects of the present invention to at least one of forming and welding.

The steel sheet according to aspects of the present invention has a tensile strength of 1310 MPa or more and high delayed fracture resistance. Accordingly, the member obtained using the steel sheet according to aspects of the present invention also has high strength and has higher delayed fracture resistance than conventional high strength members.

Use of the member according to aspects of the present invention enables weight saving. Therefore, the member according to aspects of the present invention is suitable for use in, for example, vehicle frame parts.

For the forming, any common forming method such as press forming can be used without limitation. For the welding, any common welding such as spot welding or arc welding can be used without limitation.

EXAMPLES

Example 1

Hereinafter, Examples of the present invention will be described.

Steels having chemical compositions shown in Table 1 were obtained by steelmaking and then cast into slabs.

The slabs were subjected to heat treatment and rolling shown in Table 2 to obtain steel sheets having a thickness of 1.4 mm.

Specifically, a slab having each chemical composition was heated to a heat holding temperature shown in Table 2 in terms of slab surface temperature at an average heating rate of 6° C./min and held for a heat holding time shown in Table 2. Thereafter, hot finish rolling at a finish rolling temperature shown in Table 2 was performed, and cooling at an average cooling rate of 50° C./s in the range from the finish rolling temperature to 650° C. was performed.

Thereafter, cooling and coiling at a coiling temperature shown in Table 2 were performed to obtain a hot rolled steel sheet, and the hot rolled steel sheet was cold rolled at a rolling reduction (cold rolling reduction) shown in Table 2 to obtain a cold rolled steel sheet.

Thereafter, the cold rolled steel sheet was heated from 700° C. to an annealing temperature shown in Table 2 at an average heating rate shown in Table 2 and soaked at the annealing temperature for a soaking time shown in Table 2.

Thereafter, cooling was performed from a cooling start temperature shown in Table 2 to a cooling stop temperature shown in Table 2 at an average cooling rate shown in Table 2, reheating was performed as needed, and then continuous annealing including holding at a holding temperature shown in Table 2 for a holding time shown in Table 2 was performed.

In Table 2, the cold rolled steel sheet (CR) of No. 4 was electrogalvanized into an electrogalvanized steel sheet (EG). In Table 2, the surface temperature of the slabs was measured with a radiation thermometer, and the central temperature of the slabs was determined by heat transfer calculations.

TABLE 1

| Steel | Chemical composition (mass %) | | | | | | | | | |
|---|---|---|---|---|---|---|---|---|---|---|
| grade | C | Si | Mn | P | S | sol.Al | N | Ti | Nb | B |
| A | 0.14 | 1.42 | 0.81 | 0.006 | 0.0007 | 0.042 | 0.0031 | 0.012 | 0.006 | — |
| B | 0.19 | 1.42 | 0.60 | 0.004 | 0.0004 | 0.030 | 0.0025 | 0.040 | — | — |
| C | 0.26 | 1.24 | 1.17 | 0.013 | 0.0003 | 0.035 | 0.0043 | 0.050 | 0.019 | — |
| D | 0.30 | 0.26 | 0.74 | 0.010 | 0.0006 | 0.036 | 0.0047 | 0.050 | 0.015 | — |
| E | 0.22 | 0.26 | 0.56 | 0.024 | 0.0006 | 0.030 | 0.0023 | 0.014 | 0.010 | — |
| F | 0.28 | 0.81 | 1.03 | 0.015 | 0.0008 | 0.049 | 0.0034 | 0.035 | 0.020 | — |
| G | 0.33 | 1.44 | 0.80 | 0.008 | 0.0004 | 0.041 | 0.0025 | 0.023 | 0.008 | — |
| H | 0.20 | 0.30 | 0.40 | 0.019 | 0.0004 | 0.027 | 0.0020 | 0.010 | 0.015 | — |
| I | 0.25 | 0.30 | 1.10 | 0.017 | 0.0009 | 0.024 | 0.0028 | 0.030 | 0.012 | — |
| J | 0.18 | 0.30 | 1.50 | 0.022 | 0.0007 | 0.024 | 0.0027 | 0.025 | 0.021 | 0.0062 |
| K | 0.32 | 0.21 | 1.35 | 0.008 | 0.0007 | 0.049 | 0.0021 | 0.014 | 0.007 | 0.0017 |
| M | 0.28 | 0.49 | 0.77 | 0.007 | 0.0007 | 0.040 | 0.0041 | 0.048 | 0.007 | 0.0016 |
| L | 0.16 | 0.49 | 0.66 | 0.028 | 0.0005 | 0.033 | 0.0032 | 0.012 | 0.005 | 0.0010 |
| N | 0.17 | 0.72 | 0.91 | 0.024 | 0.0002 | 0.030 | 0.0033 | 0.018 | 0.018 | 0.0015 |
| O | 0.19 | 0.72 | 0.30 | 0.014 | 0.0003 | 0.040 | 0.0016 | 0.007 | 0.020 | 0.0020 |
| P | 0.24 | 1.24 | 1.25 | 0.018 | 0.0005 | 0.036 | 0.0020 | 0.012 | 0.013 | 0.0010 |
| Q | 0.24 | 1.24 | 1.32 | 0.024 | 0.0008 | 0.040 | 0.0030 | 0.030 | 0.016 | 0.0021 |
| R | 0.20 | 1.24 | 0.49 | 0.023 | 0.0005 | 0.028 | 0.0040 | 0.041 | 0.006 | 0.0008 |
| S | 0.15 | 1.11 | 1.51 | 0.029 | 0.0008 | 0.033 | 0.0042 | 0.010 | 0.005 | 0.0023 |
| T | 0.22 | 1.11 | 0.62 | 0.027 | 0.0006 | 0.032 | 0.0035 | 0.008 | 0.002 | 0.0010 |
| U | 0.26 | 0.70 | 1.13 | 0.014 | 0.0005 | 0.032 | 0.0037 | 0.010 | 0.021 | 0.0020 |
| V | 0.22 | 0.70 | 1.34 | 0.026 | 0.0006 | 0.045 | 0.0039 | 0.006 | 0.030 | 0.0009 |
| W | 0.17 | 0.70 | 1.12 | 0.010 | 0.0008 | 0.028 | 0.0034 | 0.007 | 0.002 | 0.0020 |
| X | 0.20 | 0.93 | 0.62 | 0.026 | 0.0002 | 0.031 | 0.0028 | 0.010 | 0.012 | 0.0016 |
| Y | 0.27 | 0.93 | 1.30 | 0.015 | 0.0002 | 0.025 | 0.0018 | 0.040 | 0.022 | 0.0015 |
| Z | 0.31 | 0.86 | 0.80 | 0.010 | 0.0004 | 0.029 | 0.0031 | 0.031 | 0.012 | 0.0026 |
| AA | 0.32 | 0.86 | 1.12 | 0.015 | 0.0002 | 0.030 | 0.0039 | 0.040 | 0.011 | 0.0016 |
| AB | 0.27 | 0.13 | 1.08 | 0.013 | 0.0003 | 0.023 | 0.0024 | 0.050 | 0.010 | 0.0020 |
| AC | 0.10 | 1.42 | 1.31 | 0.004 | 0.0003 | 0.037 | 0.0044 | 0.060 | 0.004 | — |
| AD | 0.42 | 0.26 | 0.82 | 0.023 | 0.0004 | 0.044 | 0.0036 | 0.035 | 0.008 | — |
| AE | 0.31 | 1.58 | 1.00 | 0.008 | 0.0007 | 0.045 | 0.0038 | 0.041 | 0.008 | — |

TABLE 1-continued

| | | | | | | | | | | |
|---|---|---|---|---|---|---|---|---|---|---|
| AF | 0.32 | 0.21 | 1.36 | 0.050 | 0.0002 | 0.026 | 0.0029 | 0.030 | 0.012 | — |
| AG | 0.27 | 0.49 | 1.02 | 0.009 | 0.0020 | 0.047 | 0.0032 | 0.018 | 0.012 | — |
| AH | 0.25 | 0.72 | 0.99 | 0.021 | 0.0003 | 0.230 | 0.0026 | 0.023 | 0.022 | — |
| AI | 0.36 | 1.11 | 1.05 | 0.012 | 0.0003 | 0.020 | 0.0055 | 0.020 | 0.018 | — |
| AJ | 0.30 | 0.93 | 0.73 | 0.029 | 0.0002 | 0.038 | 0.0045 | 0.010 | 0.080 | — |
| AK | 0.30 | 0.93 | 0.40 | 0.210 | 0.0003 | 0.026 | 0.0024 | 0.001 | 0.002 | — |
| AL | 0.24 | 0.13 | 1.60 | 0.024 | 0.0007 | 0.035 | 0.0041 | 0.080 | 0.010 | — |
| AM | 0.30 | 0.13 | 0.00 | 0.011 | 0.0002 | 0.021 | 0.0014 | 0.005 | 0.016 | 0.0112 |

| Steel | Chemical composition (mass %) | | $Ar_3$ temperature | |
|---|---|---|---|---|
| grade | others | Ti + Nb | (° C.) (*1) | Remarks |
| A | — | 0.018 | 802 | Conforming |
| B | — | 0.040 | 803 | Conforming |
| C | — | 0.069 | 736 | Conforming |
| D | — | 0.065 | 758 | Conforming |
| E | — | 0.024 | 797 | Conforming |
| F | — | 0.055 | 741 | Conforming |
| G | — | 0.031 | 744 | Conforming |
| H | — | 0.025 | 816 | Conforming |
| I | — | 0.042 | 745 | Conforming |
| J | — | 0.046 | 734 | Conforming |
| K | — | 0.021 | 703 | Conforming |
| M | — | 0.055 | 762 | Conforming |
| L | — | 0.017 | 808 | Conforming |
| N | — | 0.036 | 785 | Conforming |
| O | — | 0.027 | 827 | Conforming |
| P | — | 0.025 | 736 | Conforming |
| Q | — | 0.046 | 730 | Conforming |
| R | — | 0.047 | 809 | Conforming |
| S | — | 0.015 | 743 | Conforming |
| T | — | 0.010 | 792 | Conforming |
| U | Cu: 0.20 | 0.031 | 735 | Conforming |
| V | Ni: 0.20, Mg: 0.0010 | 0.036 | 724 | Conforming |
| W | Mo: 0.05, V: 0.05 | 0.009 | 764 | Conforming |
| X | Mo: 0.10, Ca: 0.0020 | 0.022 | 790 | Conforming |
| Y | Cr: 0.10, Mo: 0.05, Ce: 0.0010 | 0.062 | 717 | Conforming |
| Z | La: 0.0010, Sb: 0.006, REM: 0.0010 | 0.043 | 750 | Conforming |
| AA | Zr: 0.008, Sn: 0.003, W: 0.050 | 0.051 | 721 | Conforming |
| AB | — | 0.060 | 740 | Conforming |
| AC | — | 0.064 | 774 | Comparative |
| AD | — | 0.043 | 714 | Comparative |
| AE | — | 0.049 | 734 | Comparative |
| AF | — | 0.042 | 702 | Comparative |
| AG | — | 0.030 | 745 | Comparative |
| AH | — | 0.045 | 753 | Comparative |
| AI | — | 0.038 | 714 | Comparative |
| AJ | — | 0.090 | 759 | Comparative |
| AK | — | 0.003 | 785 | Comparative |
| AL | — | 0.090 | 708 | Comparative |
| AM | — | 0.021 | 817 | Comparative |

The balance other than the above is Fe and incidental impurities.

(*1) $Ar_3$ temperature = 910-310 × [C]-80 × [Mn]-20 × [Cu]-15 × [Cr]-55 × [Ni]-80 × [Mo] (In the formula, [M] is a content (mass %) of an element M.)

TABLE 2

| | | Hot rolling | | | | Cold rolling | Continuous annealing | |
|---|---|---|---|---|---|---|---|---|
| Steel sheet No. | Steel grade | Heat holding temperature (° C.) | Heat holding time (min) | Finish rolling temperature (° C.) | Coiling temperature (° C.) | Rolling reduction (%) | Annealing temperature (° C.) | Average heating rate (° C./s) |
| 1 | A | 1250 | 150 | 870 | 580 | 60 | 900 | 0.5 |
| 2 | B | 1250 | 150 | 870 | 580 | 60 | 900 | 0.5 |
| 3 | C | 1250 | 150 | 870 | 580 | 60 | 900 | 0.5 |
| 4 | D | 1250 | 150 | 870 | 580 | 60 | 900 | 0.5 |
| 5 | E | 1250 | 180 | 870 | 550 | 60 | 900 | 0.5 |
| 6 | F | 1250 | 180 | 870 | 550 | 60 | 900 | 0.5 |
| 7 | G | 1280 | 180 | 870 | 550 | 65 | 900 | 0.5 |
| 8 | H | 1280 | 180 | 870 | 550 | 65 | 900 | 0.5 |
| 9 | I | 1280 | 120 | 870 | 550 | 65 | 900 | 0.8 |
| 10 | J | 1280 | 120 | 890 | 550 | 65 | 870 | 0.8 |
| 11 | K | 1280 | 120 | 890 | 600 | 65 | 870 | 0.8 |

TABLE 2-continued

| | | | | | | | | |
|---|---|---|---|---|---|---|---|---|
| 12 | M | 1280 | 120 | 890 | 600 | 65 | 870 | 0.8 |
| 13 | L | 1320 | 100 | 890 | 600 | 65 | 870 | 0.8 |
| 14 | N | 1320 | 100 | 890 | 600 | 65 | 870 | 0.8 |
| 15 | O | 1320 | 100 | 890 | 600 | 65 | 870 | 0.8 |
| 16 | P | 1320 | 100 | 890 | 600 | 65 | 870 | 0.8 |
| 17 | Q | 1320 | 40 | 890 | 570 | 65 | 870 | 0.8 |
| 18 | R | 1320 | 40 | 890 | 570 | 65 | 870 | 1.0 |
| 19 | S | 1350 | 40 | 890 | 570 | 65 | 890 | 1.0 |
| 20 | T | 1350 | 40 | 860 | 570 | 58 | 890 | 1.0 |
| 21 | U | 1350 | 200 | 860 | 570 | 58 | 890 | 1.0 |
| 22 | V | 1350 | 200 | 860 | 570 | 58 | 890 | 1.0 |
| 23 | W | 1350 | 200 | 860 | 570 | 58 | 890 | 1.0 |
| 24 | X | 1350 | 200 | 860 | 590 | 58 | 890 | 1.0 |
| 25 | Y | 1260 | 160 | 860 | 590 | 58 | 890 | 1.0 |
| 26 | Z | 1260 | 160 | 860 | 590 | 58 | 920 | 0.7 |
| 27 | AA | 1260 | 160 | 860 | 590 | 53 | 920 | 0.7 |
| 28 | AB | 1260 | 160 | 910 | 590 | 53 | 920 | 0.7 |
| 29 | AC | 1260 | 80 | 910 | 590 | 53 | 920 | 0.7 |
| 30 | AD | 1260 | 80 | 910 | 590 | 53 | 920 | 0.7 |
| 31 | AE | 1320 | 80 | 910 | 590 | 53 | 920 | 0.7 |
| 32 | AF | 1320 | 60 | 910 | 580 | 53 | 860 | 0.7 |
| 33 | AG | 1320 | 60 | 910 | 580 | 56 | 860 | 0.7 |
| 34 | AH | 1320 | 60 | 910 | 580 | 56 | 860 | 0.7 |
| 35 | AI | 1250 | 60 | 870 | 580 | 56 | 860 | 0.7 |
| 36 | AJ | 1250 | 180 | 870 | 590 | 56 | 860 | 1.2 |
| 37 | AK | 1250 | 180 | 870 | 590 | 56 | 860 | 1.2 |
| 38 | AL | 1250 | 180 | 870 | 590 | 56 | 860 | 1.2 |
| 39 | AM | 1250 | 180 | 870 | 590 | 56 | 860 | 1.2 |
| 40 | Y | 1210 | 180 | 870 | 590 | 59 | 910 | 1.2 |
| 41 | Y | 1290 | 20 | 880 | 590 | 59 | 910 | 1.2 |
| 42 | Y | 1290 | 150 | 880 | 650 | 59 | 910 | 1.2 |
| 43 | Y | 1290 | 150 | 880 | 570 | 59 | 910 | 0.1 |
| 44 | Y | 1290 | 150 | 880 | 570 | 59 | 910 | 0.9 |
| 45 | Y | 1290 | 150 | 880 | 570 | 59 | 940 | 0.9 |
| 46 | Y | 1290 | 150 | 880 | 570 | 59 | 960 | 0.9 |

| | Continuous annealing | | | | | | |
|---|---|---|---|---|---|---|---|
| Steel sheet No. | Soaking time (s) | Cooling start temperature (° C.) | Average cooling rate (° C./s) | Cooling stop temperature (° C.) | Holding temperature (° C.) | Holding time (s) | Remarks |
| 1 | 360 | 760 | 840 | 30 | 180 | 780 | Conforming |
| 2 | 360 | 760 | 840 | 30 | 180 | 780 | Conforming |
| 3 | 360 | 760 | 840 | 30 | 180 | 780 | Conforming |
| 4 | 360 | 760 | 840 | 30 | 180 | 780 | Conforming |
| 5 | 360 | 780 | 840 | 30 | 180 | 780 | Conforming |
| 6 | 360 | 780 | 840 | 30 | 190 | 780 | Conforming |
| 7 | 360 | 780 | 840 | 30 | 190 | 780 | Conforming |
| 8 | 420 | 780 | 790 | 30 | 190 | 780 | Conforming |
| 9 | 420 | 780 | 790 | 30 | 190 | 900 | Conforming |
| 10 | 420 | 790 | 790 | 30 | 190 | 900 | Conforming |
| 11 | 420 | 790 | 790 | 30 | 190 | 900 | Conforming |
| 12 | 420 | 790 | 790 | 30 | 190 | 900 | Conforming |
| 13 | 420 | 790 | 790 | 25 | 200 | 900 | Conforming |
| 14 | 420 | 720 | 790 | 25 | 200 | 900 | Conforming |
| 15 | 420 | 720 | 790 | 25 | 200 | 900 | Conforming |
| 16 | 420 | 690 | 860 | 25 | 200 | 900 | Conforming |
| 17 | 480 | 720 | 860 | 25 | 200 | 900 | Conforming |
| 18 | 480 | 720 | 860 | 25 | 200 | 1080 | Conforming |
| 19 | 480 | 720 | 860 | 25 | 200 | 1080 | Conforming |
| 20 | 480 | 750 | 860 | 25 | 210 | 1080 | Conforming |
| 21 | 480 | 750 | 860 | 25 | 210 | 1080 | Conforming |
| 22 | 480 | 750 | 860 | 25 | 210 | 1080 | Conforming |
| 23 | 480 | 750 | 860 | 25 | 210 | 1080 | Conforming |
| 24 | 480 | 750 | 860 | 25 | 210 | 1080 | Conforming |
| 25 | 540 | 830 | 860 | 25 | 210 | 1080 | Conforming |
| 26 | 540 | 830 | 80 | 23 | 230 | 600 | Conforming |
| 27 | 540 | 830 | 820 | 23 | 230 | 600 | Conforming |
| 28 | 540 | 830 | 820 | 23 | 230 | 600 | Conforming |
| 29 | 540 | 830 | 820 | 23 | 230 | 600 | Comparative |
| 30 | 540 | 810 | 820 | 23 | 230 | 600 | Comparative |
| 31 | 540 | 810 | 820 | 23 | 230 | 600 | Comparative |
| 32 | 180 | 810 | 820 | 23 | 240 | 600 | Comparative |
| 33 | 180 | 810 | 760 | 23 | 240 | 540 | Comparative |
| 34 | 180 | 810 | 760 | 23 | 240 | 540 | Comparative |
| 35 | 180 | 810 | 760 | 23 | 240 | 540 | Comparative |
| 36 | 180 | 860 | 760 | 34 | 240 | 540 | Comparative |
| 37 | 180 | 860 | 760 | 34 | 170 | 540 | Comparative |
| 38 | 180 | 860 | 760 | 34 | 170 | 540 | Comparative |

TABLE 2-continued

| | | | | | | | |
|---|---|---|---|---|---|---|---|
| 39 | 240 | 860 | 760 | 34 | 170 | 540 | Comparative |
| 40 | 240 | 860 | 760 | 34 | 170 | 720 | Comparative |
| 41 | 240 | 860 | 760 | 34 | 170 | 720 | Comparative |
| 42 | 240 | 800 | 760 | 34 | 190 | 720 | Comparative |
| 43 | 240 | 800 | 830 | 34 | 190 | 720 | Comparative |
| 44 | 240 | 670 | 830 | 34 | 190 | 720 | Comparative |
| 45 | 540 | 800 | 830 | 15 | 190 | 720 | Conforming |
| 46 | 540 | 800 | 830 | 15 | 190 | 720 | Comparative |

For each of the steel sheets obtained, its metallic microstructure was quantified by the above-described method, and, furthermore, a tensile test and a delayed fracture resistance evaluation test were performed.

Specifically, the microstructure was measured in the following manner.

The area fractions of martensite, bainite, and ferrite were measured in the following manner. An L section (a section parallel to the rolling direction and perpendicular to the steel sheet surface) of the steel sheet was polished and then etched with nital, four view areas were observed under SEM at a magnification of 2000× at a position ¼ thickness deep from the steel sheet surface, and microstructure images captured were subjected to image analysis. Here, martensite and bainite are microstructures exhibiting a gray or white color in SEM. Here, bainite has the following features. Specifically, bainite is in the form of a plate having an aspect ratio of 2.5 or more and is a microstructure that is somewhat blacker than martensite. The plate has a width (breadth) of 0.3 to 1.7 μm. The distribution density of a carbide having a diameter of 10 to 200 nm inside bainite is 0 to 3 pieces/$\mu m^2$. By contrast, ferrite is a region exhibiting a black color in SEM. Martensite and bainite include traces of carbides, nitrides, sulfides, and oxides, but since it is difficult to exclude them, area fractions of regions including them were used as the area fractions of martensite and bainite. Retained austenite (retained γ) was measured by chemically polishing a surface of the steel sheet by 200 μm with oxalic acid and analyzing the resulting surface by an X-ray diffraction intensity method. Integral intensities of peaks of (200)α, (211)α, (220)α, (200)γ, (220)γ, and (311)γ diffraction planes measured with Mo-Kα radiation were used to make calculations.

The average grain size of prior-austenite grains (prior-γ grain size) was measured in the following manner. An L section (a section parallel to the rolling direction and perpendicular to the steel sheet surface) of the steel sheet was polished and then etched with a chemical solution (e.g., a saturated aqueous picric acid solution or a saturated aqueous picric acid solution with ferric chloride added) for etching prior-γ grain boundaries, four view areas were observed under a light microscope at a magnification of 500× at a position ¼ thickness deep from the steel sheet surface, 15 lines were drawn at intervals of 10 μm or more in actual length in each of the thickness direction and the rolling direction in the images obtained, and the number of intersections of grain boundaries and the lines was counted. The total line length was divided by the number of intersections, and the value obtained was multiplied by 1.13 to determine the prior-γ grain size.

The percentage of Nb and Ti forming carbonitrides having an equivalent circular diameter of 100 nm or more among Nb and Ti contained can be measured by the following method.

After a predetermined amount of sample is electrolyzed in an electrolyte, a sample piece is taken out of the electrolyte and immersed in a solution having dispersibility. Subsequently, precipitates contained in the solution are filtered through a filter with a pore size of 100 nm. The precipitates collected on the filter with a pore size of 100 nm are the carbonitrides having a diameter (equivalent circular diameter) of 100 nm or more. The residue on the filter and the filtrate obtained by the filtering were analyzed for Nb amount and Ti amount to determine the contents of Nb and Ti in the carbonitrides having a diameter of 100 nm or more and carbonitrides having a diameter of less than 100 nm. For the analysis, inductively coupled plasma (ICP) emission spectroscopic analysis can be used. The percentage of the total amount of Nb and Ti in the carbonitrides having a diameter of 100 nm or more to the total amount of Nb and Ti in steel is then calculated.

The number (distribution density) of the Nb carbonitride and the Ti carbonitride per $mm^2$ can be determined as follows: after an L section (a vertical section parallel to the rolling direction) of the steel sheet is polished, in a region extending from the ⅕ thickness position to the ⅘ thickness position of the steel sheet without etching, that is, a region extending from a position ⅕ deep from the steel sheet surface in the thickness direction to the middle of the thickness and further to the ⅘ position, regions of 2 $mm^2$ or more are continuously photographed by SEM, and the number of the carbonitrides are calculated in the SEM photographs captured. Here, the SEM images are preferably backscattered electron images. The magnification in the photographing may be 2000×. However, when it is difficult to accurately discern the size of precipitates at a magnification of 2000×, individual inclusion particles may be enlarged to 10000 times as appropriate to demarcate the carbonitrides.

For the tensile test, a JIS No. 5 tensile test specimen was cut out at a coil width ¼ position such that a direction perpendicular to the rolling direction is the longitudinal direction of the specimen, and a tensile test (in accordance with JIS Z 2241) was performed to evaluate YP, TS, and El.

The evaluation of delayed fracture resistance was performed in the following manner. A conventional strain rate technique (CSRT) specimen was cut out from the obtained steel sheet (coil) at the coil width ¼ position in the width direction of the steel sheet such that a direction perpendicular to the rolling direction was the longitudinal direction of the test specimen. The CSRT specimen was a tensile test specimen having a reduced section with a width of 12.5 mm and a length of 25 mm, both ends of the reduced section having a semicircular notch with a radius of 3 mm. A 10 mass % aqueous ammonium thiocyanate solution and a McIlvaine buffer solution having a pH of 3 were mixed at a volume ratio of 1:1, in the resulting solution (pH 3) at 20° C. adjusted such that the fluid volume per $cm^2$ of surface area of the test specimen was 20 ml, the CSRT specimen was immersed for 24 hours to allow hydrogen to enter and diffuse through the test specimen, and immediately after the lapse of 24 hours, a tensile test was carried out at a crosshead speed of 1 mm/min to measure a fracture stress. The delayed fracture resistance was evaluated by $\sigma_1/\sigma_0$, where $\sigma_0$ is a fracture stress measured when immersion is not performed, and $\sigma_1$ is a fracture stress measured after hydrogen is allowed to enter and diffuse by immersion. Here, those whose $\sigma_1/\sigma_0$ values were 0.80 or more when TS was 1310 MPa or more and less than 1500 MPa, those whose $\sigma_1/\sigma_0$ values were 0.50 or more when TS was 1500 MPa or more and less than 1800 MPa, and those whose $\sigma_1/\sigma_0$ values were 0.35 or more when TS was 1800 MPa or more were evaluated as having high delayed fracture resistance.

The microstructure and properties of the steel sheets obtained are shown in Table 3.

TABLE 3

| Steel sheet No. | Steel grade | Martensite area fraction (%) | Balance area fraction (%) (*1) | Prior-γ grain size (μm) | Amount of Nb and Ti carbonitrides of 100 nm or more (mass %) | Number density of Nb and Ti carbonitrides (piece/mm$^2$) (*2) | TS (MPa) | σ0 (MPa) | σ1 (MPa) | σ1/σ0 | Remarks |
|---|---|---|---|---|---|---|---|---|---|---|---|
| 1 | A | 100 | 0 | 8.2 | 93 | 81 | 1373 | 1580 | 1462 | 0.93 | Conforming |
| 2 | B | 100 | 0 | 5.3 | 92 | 298 | 1520 | 1745 | 1199 | 0.69 | Conforming |
| 3 | C | 100 | 0 | 3.8 | 93 | 610 | 1723 | 1990 | 1483 | 0.75 | Conforming |
| 4 | D | 100 | 0 | 3.9 | 93 | 553 | 1830 | 2110 | 1520 | 0.72 | Conforming |
| 5 | E | 100 | 0 | 7.0 | 94 | 127 | 1601 | 1833 | 1678 | 0.92 | Conforming |
| 6 | F | 100 | 0 | 4.3 | 92 | 453 | 1742 | 1999 | 1208 | 0.60 | Conforming |
| 7 | G | 100 | 0 | 5.8 | 94 | 171 | 1900 | 2154 | 1641 | 0.76 | Conforming |
| 8 | H | 100 | 0 | 5.9 | 93 | 84 | 1513 | 1746 | 1498 | 0.86 | Conforming |
| 9 | I | 100 | 0 | 4.8 | 93 | 253 | 1640 | 1885 | 1487 | 0.79 | Conforming |
| 10 | J | 100 | 0 | 4.5 | 91 | 281 | 1435 | 1633 | 1524 | 0.93 | Conforming |
| 11 | K | 100 | 0 | 7.0 | 94 | 84 | 1849 | 2120 | 975 | 0.46 | Conforming |
| 12 | L | 100 | 0 | 4.1 | 95 | 377 | 1735 | 1985 | 1188 | 0.60 | Conforming |
| 13 | M | 100 | 0 | 6.9 | 95 | 41 | 1368 | 1567 | 1465 | 0.93 | Conforming |
| 14 | N | 100 | 0 | 4.7 | 96 | 119 | 1398 | 1600 | 1510 | 0.94 | Conforming |
| 15 | O | 100 | 0 | 5.0 | 95 | 49 | 1454 | 1673 | 1308 | 0.78 | Conforming |
| 16 | P | 96 | 4 | 5.5 | 95 | 60 | 1532 | 1761 | 1102 | 0.63 | Conforming |
| 17 | Q | 100 | 0 | 4.2 | 95 | 202 | 1599 | 1835 | 1478 | 0.81 | Conforming |
| 18 | R | 100 | 0 | 4.3 | 96 | 244 | 1478 | 1701 | 1498 | 0.88 | Conforming |
| 19 | S | 100 | 0 | 6.8 | 96 | 22 | 1340 | 1443 | 1437 | 1.00 | Conforming |
| 20 | T | 100 | 0 | 8.4 | 94 | 14 | 1498 | 1716 | 1541 | 0.90 | Conforming |
| 21 | U | 100 | 0 | 4.5 | 98 | 44 | 1590 | 1820 | 1635 | 0.90 | Conforming |
| 22 | V | 100 | 0 | 4.1 | 98 | 41 | 1482 | 1701 | 1433 | 0.84 | Conforming |
| 23 | W | 100 | 0 | 8.8 | 93 | 11 | 1346 | 1545 | 1430 | 0.93 | Conforming |
| 24 | X | 100 | 0 | 5.5 | 98 | 31 | 1431 | 1650 | 1504 | 0.91 | Conforming |
| 25 | Y | 100 | 0 | 4.3 | 93 | 501 | 1625 | 1864 | 1475 | 0.79 | Conforming |
| 26 | Z | 100 | 0 | 4.9 | 95 | 301 | 1688 | 1946 | 1328 | 0.68 | Conforming |
| 27 | AA | 100 | 0 | 4.4 | 93 | 374 | 1712 | 1963 | 1075 | 0.55 | Conforming |
| 28 | AB | 100 | 0 | 4.0 | 92 | 466 | 1570 | 1802 | 1231 | 0.68 | Conforming |
| 29 | AC | 100 | 0 | 3.9 | 93 | 504 | 1089 | 1260 | 1249 | 0.99 | Comparative |
| 30 | AD | 100 | 0 | 4.9 | 93 | 297 | 2001 | 2312 | 743 | 0.32 | Comparative |
| 31 | AE | 100 | 0 | 4.2 | 95 | 255 | 1686 | 1926 | 930 | 0.48 | Comparative |
| 32 | AF | 100 | 0 | 4.5 | 96 | 183 | 1690 | 1943 | 597 | 0.31 | Comparative |
| 33 | AG | 100 | 0 | 5.2 | 94 | 98 | 1553 | 1762 | 707 | 0.40 | Comparative |
| 34 | AH | 100 | 0 | 4.2 | 93 | 175 | 1997 | 2280 | 689 | 0.30 | Comparative |
| 35 | AI | 100 | 0 | 5.6 | 94 | 288 | 1790 | 2031 | 956 | 0.47 | Comparative |
| 36 | AJ | 100 | 0 | 3.2 | 92 | 884 | 1646 | 1998 | 824 | 0.41 | Comparative |
| 37 | AK | 100 | 0 | 12.9 | 88 | 21 | 1857 | 2129 | 680 | 0.32 | Comparative |
| 38 | AL | 100 | 0 | 3.2 | 97 | 868 | 1687 | 1943 | 669 | 0.34 | Comparative |
| 39 | AM | 100 | 0 | 6.4 | 96 | 65 | 1854 | 2119 | 597 | 0.28 | Comparative |
| 40 | Y | 100 | 0 | 6.5 | 97 | 865 | 1762 | 2022 | 749 | 0.37 | Comparative |
| 41 | Y | 100 | 0 | 7.7 | 96 | 1020 | 1765 | 2025 | 843 | 0.42 | Comparative |
| 42 | Y | 100 | 0 | 11.0 | 95 | 620 | 1708 | 1957 | 944 | 0.48 | Comparative |
| 43 | Y | 100 | 0 | 13.0 | 94 | 521 | 1702 | 1949 | 902 | 0.46 | Comparative |
| 44 | Y | 92 | 8 | 5.1 | 95 | 510 | 1627 | 1867 | 923 | 0.49 | Comparative |
| 45 | Y | 100 | 0 | 17.5 | 94 | 480 | 1702 | 1957 | 992 | 0.51 | Conforming |
| 46 | Y | 100 | 0 | 19.5 | 93 | 480 | 1699 | 1958 | 886 | 0.45 | Comparative |

(*1) Balance area fraction: Total area fraction of bainite, ferrite, and retained austenite (*2) Number density of Nb and Ti carbonitrides: Total number density of a Nb carbonitride and a Ti carbonitride having an equivalent circular diameter of 1.0 μm or more Steel sheets within the scope according to aspects of the present invention had high strength and high delayed fracture resistance.

By contrast, No. 29 (steel grade AC) had an insufficient C content and insufficient TS.

No. 30 (steel grade AD) had an excessive C content, thus failing to achieve sufficient delayed fracture resistance.

No. 31 (steel grade AE) had an excessive Si content, thus failing to achieve sufficient delayed fracture resistance.

No. 32 (steel grade AF) had an excessive P content, thus failing to achieve sufficient delayed fracture resistance.

No. 33 (steel grade AG) had an excessive S content, thus failing to achieve sufficient delayed fracture resistance.

No. 34 (steel grade AH) had an excessive sol. Al content, thus failing to achieve sufficient delayed fracture resistance.

No. 35 (steel grade AI) had an excessive N content, thus failing to achieve sufficient delayed fracture resistance.

No. 36 (steel grade AJ) and No. 38 (steel grade AL) had an excessive total Nb and Ti content, which resulted in an excessive presence of precipitates of 1.0 μm or more, thus failing to achieve sufficient delayed fracture resistance.

No. 37 (steel grade AK) had an insufficient total Nb and Ti content, thus failing to achieve sufficient delayed fracture resistance.

No. 39 (steel grade AM) had an excessive B content, thus failing to achieve sufficient delayed fracture resistance.

No. 40 (steel grade Y), in which Nb and Ti were not sufficiently dissolved due to a low heating temperature (slab surface temperature (SRT)) and thus Nb and Ti precipitates of 1.0 μm or more were present in large numbers, failed to achieve sufficient delayed fracture resistance.

No. 41 (steel grade Y), in which Nb and Ti were not sufficiently dissolved due to too short a slab heat holding time and thus Nb and Ti precipitates of 1.0 μm or more were present in large numbers, failed to achieve sufficient delayed fracture resistance.

No. 42 (steel grade Y) was coiled at a high coiling temperature (CT), thus failing to achieve sufficient delayed fracture resistance.

No. 43 (steel grade Y) was heated at a low average heating rate during annealing, thus failing to achieve sufficient delayed fracture resistance.

No. 44 (steel grade Y) was cooled at a low cooling start temperature, which resulted in ferrite formation and insufficient martensite formation, thus failing to achieve sufficient delayed fracture resistance.

No. 46 (steel grade Y) was annealed at a high annealing temperature, which resulted in insufficient reduction in prior-γ grain size, thus failing to achieve sufficient delayed fracture resistance.

Example 2

A galvanized steel sheet obtained by galvanizing the steel sheet according to the manufacturing condition No. 4 (Conforming Example) in Table 2 in Example 1 was subjected to press forming to manufacture a member of Inventive Example. Furthermore, a galvanized steel sheet obtained by galvanizing the steel sheet according to the manufacturing condition No. 4 (Conforming Example) in Table 2 in Example 1 and a galvanized steel sheet obtained by galvanizing the steel sheet according to the manufacturing condition No. 7 (Conforming Example) in Table 2 in Example 1 were joined by spot welding to manufacture a member of Inventive Example.

These members of Inventive Example have a tensile strength TS of 1800 MPa or more and a $\sigma_1/\sigma_0$ value of 0.35 or more, specifically, 0.70 or more, thus having high delayed fracture resistance, showing that these members are suitable for use in automotive parts and the like.

Similarly, the steel sheet according to the manufacturing condition No. 4 (Conforming Example) in Table 2 in Example 1 was subjected to press forming to manufacture a member of Inventive Example. Furthermore, the steel sheet according to the manufacturing condition No. 4 (Conforming Example) in Table 2 in Example 1 and a steel sheet according to the manufacturing condition No. 7 (Conforming Example) in Table 2 in Example 1 were joined by spot welding to manufacture a member of Inventive Example. These members of Inventive Example have a tensile strength TS of 1800 MPa or more and a $\sigma_1/\sigma_0$ value of 0.35 or more, specifically, 0.7 or more, thus having high delayed fracture resistance, showing that these members are suitable for use in automotive parts and the like.

The invention claimed is:

1. A steel sheet comprising a chemical composition containing, in mass %,

C: 0.12% or more and 0.40% or less,

Si: 1.5% or less,

Mn: 1.7% or less,

P: 0.03% or less,

S: less than 0.0020%, sol. Al: 0.20% or less,

N: 0.005% or less, and one or more of Nb and Ti with a total content of 0.005% or more and 0.080% or less, with the balance being Fe and incidental impurities, wherein the steel sheet has a microstructure in which an area fraction of martensite relative to the entire microstructure is 95% or more and 100% or less, with the balance being one or more of bainite, ferrite, and retained austenite, prior-austenite grains have an average grain size of 18 μm or less, 90 mass % or more of the total content of Nb and Ti contained is present as a carbonitride having an equivalent circular diameter of 100 nm or more, a Nb carbonitride and a Ti carbonitride, having an equivalent circular diameter of 1.0 μm or more, are present at a rate of 5 pieces/mm$^2$ or more and 800 pieces/mm$^2$ or less in total, and the steel sheet has a tensile strength of 1310 MPa or more, and optionally wherein a coating layer is disposed on a surface of the steel sheet.

2. The steel sheet according to claim 1, wherein the prior-austenite grains have an average grain size of 10 μm or less.

3. The steel sheet according to claim 2, wherein a fracture stress do before immersion in a solution containing a 10 mass % aqueous ammonium thiocyanate solution and a McIlvaine buffer solution having a pH of 3, a fracture stress $\sigma_1$ after immersion in the solution, and the tensile strength satisfy (A), (B), or (C) below:

(A) Tensile strength: 1310 MPa or more and less than 1500 MPa, and $\sigma_1/\sigma_0$ is 0.80 or more, (B) Tensile strength: 1500 MPa or more and less than 1800 MPa, and $\sigma_1/\sigma_0$ is 0.50 or more, (C) Tensile strength: 1800 MPa or more, and $\sigma_1/\sigma_0$ is 0.35 or more.

4. The steel sheet according to claim 3, wherein the chemical composition contains, in mass %, one or two or more selected from the following groups A to F:

group A:
S: less than 0.0010%,
group B:
B: 0.0100% or less,
group C:
one or two selected from Cu: 1.0% or less and Ni: 1.0% or less,
group D:
one or two or more selected from Cr: 1.0% or less, Mo: less than 0.3%, V: 0.5% or less, Zr: 0.2% or less, and W: 0.2% or less,
group E:
one or two or more selected from Ca: 0.0030% or less, Ce: 0.0030% or less, La: 0.0030% or less, REM (excluding Ce and La): 0.0030% or less, and Mg: 0.0030% or less,
group F:
one or two selected from Sb: 0.1% or less and Sn: 0.1% or less.

5. The steel sheet according to claim 2, wherein the chemical composition contains, in mass %, one or two or more selected from the following groups A to F:
group A:
S: less than 0.0010%,
group B:
B: 0.0100% or less,
group C:
one or two selected from Cu: 1.0% or less and Ni: 1.0% or less,
group D:
one or two or more selected from Cr: 1.0% or less, Mo: less than 0.3%, V: 0.5% or less, Zr: 0.2% or less, and W: 0.2% or less,
group E:
one or two or more selected from Ca: 0.0030% or less, Ce: 0.0030% or less, La: 0.0030% or less, REM (excluding Ce and La): 0.0030% or less, and Mg: 0.0030% or less,
group F:
one or two selected from Sb: 0.1% or less and Sn: 0.1% or less.

6. The steel sheet according to claim 1, wherein a fracture stress go before immersion in a solution containing a 10 mass % aqueous ammonium thiocyanate solution and a Mellvaine buffer solution having a pH of 3,
a fracture stress $\sigma_1$ after immersion in the solution, and the tensile strength satisfy (A), (B), or (C) below:
(A) Tensile strength: 1310 MPa or more and less than 1500 MPa, and $\sigma_1/\sigma_0$ is 0.80 or more,
(B) Tensile strength: 1500 MPa or more and less than 1800 MPa, and $\sigma_1/\sigma_0$ is 0.50 or more,
(C) Tensile strength: 1800 MPa or more, and $\sigma_1/\sigma_0$ is 0.35 or more.

7. The steel sheet according to claim 6, wherein the chemical composition contains, in mass %, one or two or more selected from the following groups A to F:
group A:
S: less than 0.0010%,
group B:
B: 0.0100% or less,
group C:
one or two selected from Cu: 1.0% or less and Ni: 1.0% or less,
group D:
one or two or more selected from Cr: 1.0% or less, Mo: less than 0.3%, V: 0.5% or less, Zr: 0.2% or less, and W: 0.2% or less,
group E:
one or two or more selected from Ca: 0.0030% or less, Ce: 0.0030% or less, La: 0.0030% or less, REM (excluding Ce and La): 0.0030% or less, and Mg: 0.0030% or less,
group F:
one or two selected from Sb: 0.1% or less and Sn: 0.1% or less.

8. The steel sheet according to claim 1, wherein the chemical composition contains, in mass %, one or two or more selected from the following groups A to F:
group A:
S: less than 0.0010%,
group B:
B: 0.0100% or less,
group C:
one or two selected from Cu: 1.0% or less and Ni: 1.0% or less,
group D:
one or two or more selected from Cr: 1.0% or less, Mo: less than 0.3%, V: 0.5% or less, Zr: 0.2% or less, and W: 0.2% or less,
group E:
one or two or more selected from Ca: 0.0030% or less, Ce: 0.0030% or less, La:
0.0030% or less, REM (excluding Ce and La): 0.0030% or less, and Mg: 0.0030% or less,
group F:
one or two selected from Sb: 0.1% or less and Sn: 0.1% or less.

9. A member obtained by subjecting the steel sheet according to claim 1 to at least one of forming and welding.

10. A member obtained by subjecting the steel sheet according to claim 2 to at least one of forming and welding.

11. A member obtained by subjecting the steel sheet according to claim 6 to at least one of forming and welding.

12. A member obtained by subjecting the steel sheet according to claim 3 to at least one of forming and welding.

13. A member obtained by subjecting the steel sheet according to claim 8 to at least one of forming and welding.

14. A member obtained by subjecting the steel sheet according to claim 5 to at least one of forming and welding.

15. A member obtained by subjecting the steel sheet according to claim 7 to at least one of forming and welding.

16. A member obtained by subjecting the steel sheet according to claim 4 to at least one of forming and welding.

17. A method for manufacturing a steel sheet according to claim 1, comprising:
heating a steel slab having the chemical composition from 1000° C. to a heat holding temperature of 1250° C. or higher in terms of slab surface temperature at an average heating rate of 10° C./min or less and holding the steel slab at the heat holding temperature for 30 minutes or more,
then performing hot finish rolling at a finish rolling temperature not lower than an $Ar_3$ temperature,
performing cooling at an average cooling rate of 40° C./s or more in a range from the finish rolling temperature to 650° C.,
then performing cooling and coiling at a coiling temperature of 600° C. or lower to obtain a hot rolled steel sheet,
cold rolling the hot rolled steel sheet at a rolling reduction of 40% or more to obtain a cold rolled steel sheet, and
performing continuous annealing including:
heating the cold rolled steel sheet from 700° C. to an annealing temperature set to 800° C. to 950° C. at an average heating rate of 0.4° C./s or more, performing holding at the annealing temperature for 600 seconds or less, performing cooling from a cooling start temperature of 680° C. or higher to a cooling stop temperature of 260° C. or lower at an average cooling rate of 70° C./s or more, and then performing holding at a holding temperature of 150° C. to 260° C. for 20 to 1500 seconds, and optionally further comprising performing coating treatment on a steel sheet surface after the continuous annealing.

18. A method for manufacturing a steel sheet according to claim 8, comprising:

heating a steel slab having the chemical composition from 1000° C. to a heat holding temperature of 1250° C. or higher in terms of slab surface temperature at an average heating rate of 10° C./min or less and holding the steel slab at the heat holding temperature for 30 minutes or more, then performing hot finish rolling at a finish rolling temperature not lower than an $Ar_3$ temperature, performing cooling at an average cooling rate of 40° C./s or more in a range from the finish rolling temperature to 650° C., then performing cooling and coiling at a coiling temperature of 600° C. or lower to obtain a hot rolled steel sheet, cold rolling the hot rolled steel sheet at a rolling reduction of 40% or more to obtain a cold rolled steel sheet, and performing continuous annealing including:

heating the cold rolled steel sheet from 700° C. to an annealing temperature set to 800° C. to 950° C. at an average heating rate of 0.4° C./s or more, performing holding at the annealing temperature for 600 seconds or less, performing cooling from a cooling start temperature of 680° C. or higher to a cooling stop temperature of 260° C. or lower at an average cooling rate of 70° C./s or more, and then performing holding at a holding temperature of 150° C. to 260° C. for 20 to 1500 seconds, and optionally further comprising performing coating treatment on a steel sheet surface after the continuous annealing.

19. A method for manufacturing a member, comprising a step of subjecting a steel sheet manufactured by the method for manufacturing a steel sheet according to claim 17 to at least one of forming and welding.

20. A method for manufacturing a member, comprising a step of subjecting a steel sheet manufactured by the method for manufacturing a steel sheet according to claim 18 to at least one of forming and welding.

* * * * *